US008957749B2

(12) United States Patent
Matsumoto et al.

(10) Patent No.: US 8,957,749 B2
(45) Date of Patent: Feb. 17, 2015

(54) LINEAR SOLENOID

(71) Applicant: Denso Corporation, Kariya, Aichi-pref. (JP)

(72) Inventors: Koichiro Matsumoto, Nagoya (JP); Yoshiyuki Murao, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/954,163

(22) Filed: Jul. 30, 2013

(65) Prior Publication Data

US 2014/0028422 A1 Jan. 30, 2014

(30) Foreign Application Priority Data

Jul. 30, 2012 (JP) ..... 2012-168201

(51) Int. Cl.
*H01F 7/08* (2006.01)
*H01F 5/00* (2006.01)
*H01F 7/16* (2006.01)

(52) U.S. Cl.
CPC ..... *H01F 7/1638* (2013.01); *H01F 7/1607* (2013.01); *H01F 2007/163* (2013.01)
USPC ..... 335/282; 335/255; 335/260

(58) Field of Classification Search
USPC ..... 335/220–229, 281, 282
See application file for complete search history.

(56) References Cited

U.S. PATENT DOCUMENTS

| | | | | |
|---|---|---|---|---|
| 5,551,406 | A * | 9/1996 | Everingham et al. | 123/520 |
| 6,722,627 | B2 * | 4/2004 | Murao et al. | 251/129.15 |
| 2002/0104977 | A1 * | 8/2002 | Bircann et al. | 251/129.15 |
| 2004/0257185 | A1 | 12/2004 | Telep | |
| 2005/0133099 | A1 * | 6/2005 | Ino et al. | 137/625.65 |
| 2009/0039992 | A1 * | 2/2009 | Ryuen et al. | 335/255 |
| 2011/0248805 | A1 | 10/2011 | Hamaoka et al. | |
| 2011/0285484 | A1 | 11/2011 | Hoppe et al. | |
| 2014/0028423 | A1 * | 1/2014 | Matsumoto et al. | 335/282 |

FOREIGN PATENT DOCUMENTS

| | | |
|---|---|---|
| EP | 2 568 481 | 3/2013 |
| JP | 2004-158824 | 7/2003 |

OTHER PUBLICATIONS

Matsumoto, et al., U.S. Appl. No. 13/954,167, filed Jul. 30, 2013.
Matsumoto, et al., U.S. Appl. No. 13/954,171, filed Jul. 30, 2013.
Japanese Office Action issued for Japanese Patent Application No. 2012-168201, dated Jun. 27, 2014.

* cited by examiner

*Primary Examiner* — Bernard Rojas
(74) *Attorney, Agent, or Firm* — Nixon & Vanderhye P.C.

(57) ABSTRACT

A linear solenoid includes a collar, which limits relative movement between a first stationary core and a second stationary core. The first stationary core includes a bearing portion and a fixing portion, which are formed integrally as a single integral member. The bearing portion supports the shaft. The fixing portion is fixed to the yoke while the collar is clamped between the fixing portion and the second stationary core in the axial direction.

10 Claims, 5 Drawing Sheets

LINEAR SOLENOID

CROSS REFERENCE TO RELATED APPLICATION

This application is based on and incorporates herein by reference Japanese Patent Application No. 2012-168201 filed on Jul. 30, 2012.

TECHNICAL FIELD

The present disclosure relates to a linear solenoid.

BACKGROUND

A known linear solenoid linearly drives a movable core through use of a magnetic field that is generated upon energization of a coil of a stator. For example, JP2011-222799A (corresponding to US2011/0248805A1) discloses a linear solenoid that has a first stationary core, a collar and a second stationary core, which are placed on a radially inner side of a coil and are arranged one after another in an axial direction. The first stationary core, the collar and the second stationary core are axially clamped between two yokes. At the time of assembling, first of all, the two yokes are placed axially outward of the first stationary core and the second stationary core, respectively, and contact the first stationary core and the second stationary core, respectively. Thereafter, the two yokes are flexed toward each other such that a gap between each of the two yokes and a corresponding adjacent one of the first stationary core and the second stationary core is eliminated. Finally, the two yokes are fixed together by a crimping process (a process of plastic deforming a portion of one of the yokes over a corresponding portion of the other one of the yokes by crimping).

In the linear solenoid recited in JP2011-222799A (corresponding to US2011/0248805A1), a magnetic attractive force for magnetically attracting the movable core may possibly be reduced due to an influence of an air gap, which is formed between each of the yokes and the corresponding adjacent one of the first and second stationary cores through the flexing of the yokes. Furthermore, when the size of the thus generated gap is varied from product to product, the magnetic attractive force is also varied from product to product. Furthermore, when a foreign object (such as iron debris or iron powder) is held in the gap, the magnetic attractive force may possibly be varied.

SUMMARY

The present disclosure is made in view of the above points. According to the present disclosure, there is provided a linear solenoid, which includes a coil, a first stationary core, a second stationary core, a yoke, a shaft, a movable core and a non-magnetic member. The coil is formed into an annular form. The first stationary core is placed on one side of the coil in an axial direction. The second stationary core is placed on the other side of the coil, which is opposite from the one side of the coil in the axial direction. An air gap is interposed between the first stationary core and the second stationary core in the axial direction. The yoke is located on an outer side of the coil in a radial direction and magnetically couples between the first stationary core and the second stationary core. The shaft is placed on an inner side of the air gap in the radial direction and is slidably supported by the first stationary core and the second stationary core. The shaft is configured to reciprocate in the axial direction between an initial position, which is located on a side where the second stationary core is placed, and a full stroke position, which is located on a side where the first stationary core is placed. The movable core is fixed to the shaft at a corresponding location, which is located between the first stationary core and the second stationary core in the axial direction. When the coil is energized, the movable core is moved together with the shaft in the axial direction toward the full stroke position to a position located on the inner side of the air gap in the radial direction and conducts a magnetic flux between the first stationary core and the second stationary core through the movable core. The non-magnetic member is held between the first stationary core and the second stationary core and limits relative movement between the first stationary core and the second stationary core toward each other. The stationary core is formed as a single integral member and includes a bearing portion and a fixing portion. The bearing portion slidably supports the shaft. The fixing portion outwardly extends from the bearing portion in the radial direction and is fixed to the yoke while the non-magnetic member is clamped between the fixing portion and the second stationary core in the axial direction.

BRIEF DESCRIPTION OF THE DRAWINGS

The drawings described herein are for illustration purposes only and are not intended to limit the scope of the present disclosure in any way.

DETAILED DESCRIPTION

An embodiment of the present disclosure will be described with reference to the accompanying drawings.

Figure 1:
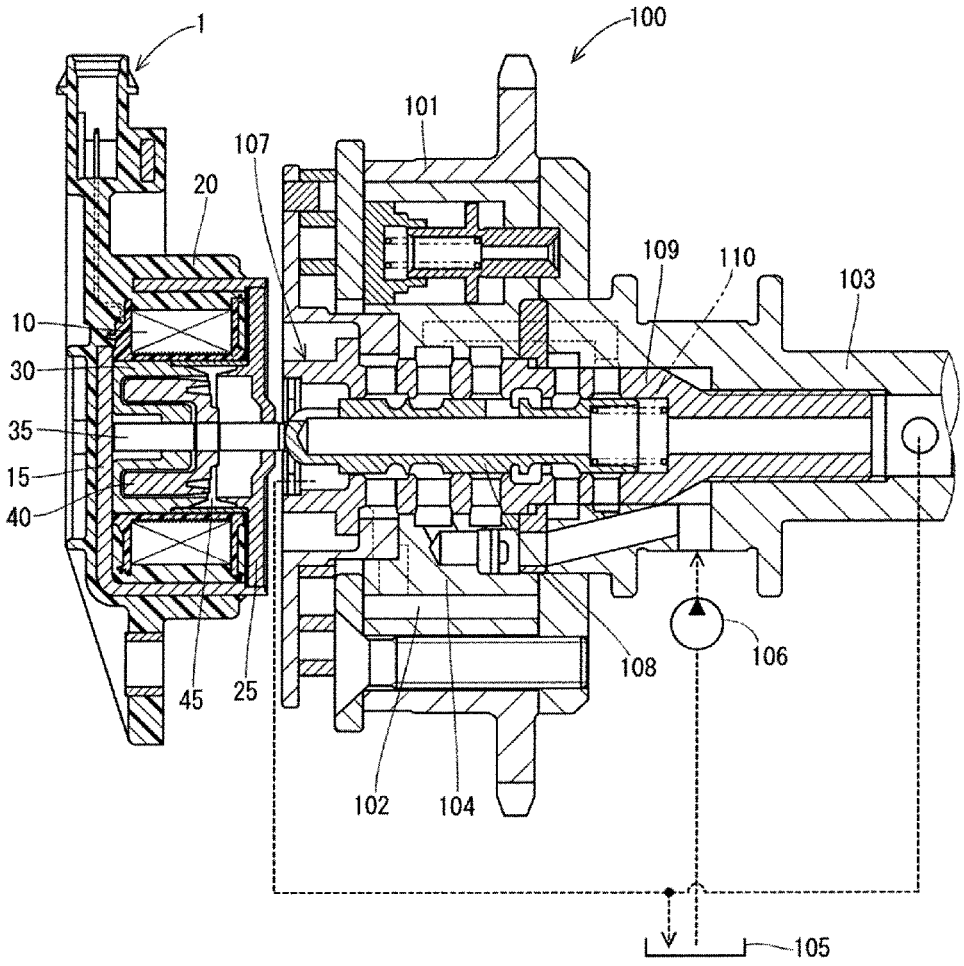
FIG. 1 is a schematic cross-sectional view of a valve timing control apparatus, in which a linear solenoid according to an embodiment of the present disclosure is applied.

FIG. 1 shows a valve timing control apparatus, which includes a linear solenoid according to an embodiment of the present disclosure. In the valve timing control apparatus 100 of the present embodiment, hydraulic oil is supplied to a hydraulic pressure chamber 102 of a case 101 that is rotatable integrally with a crankshaft of an undepicted internal combustion engine, so that a vane rotor 104, which is rotatable integrally with a camshaft 103, is rotated relative to the case 101, and thereby opening/closing timing of each corresponding one of exhaust valves (not shown) is adjusted. The hydraulic oil, which is pumped from an oil pan 105 by an oil pump 106, is supplied to the hydraulic pressure chamber 102 through a hydraulic pressure change valve 107. A spool 108 of the hydraulic pressure change valve 107 is received in a sleeve 109 in a manner that enables reciprocation of the spool 108 in an axial direction. The spool 108 is axially urged toward one side (the left side in FIG. 1) by a spring 110. The linear solenoid 1 serves as a drive device, which axially drives the spool 108 toward the other side (the right side in FIG. 1) against the urging force of the spring 110.

Figure 2:
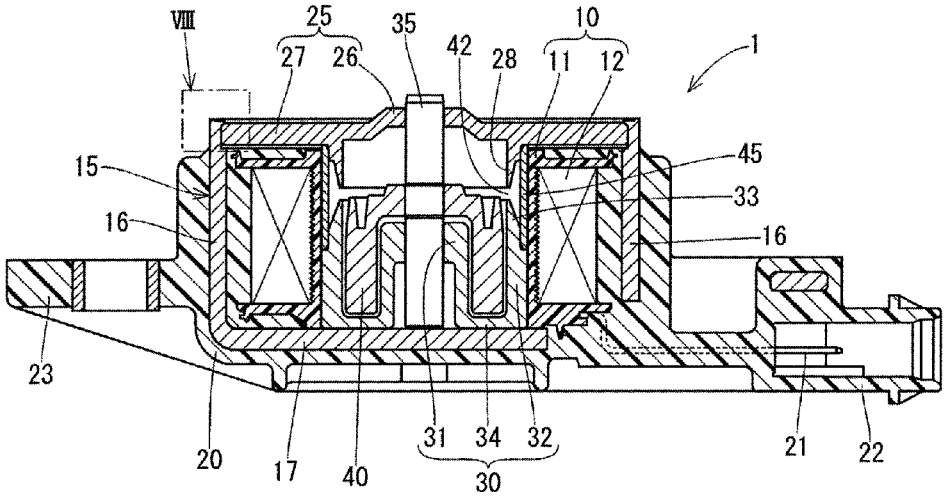
FIG. 2 is a cross-sectional view of the linear solenoid of FIG. 1, showing an operational state, in which a shaft is placed in an initial position.
Figure 3:
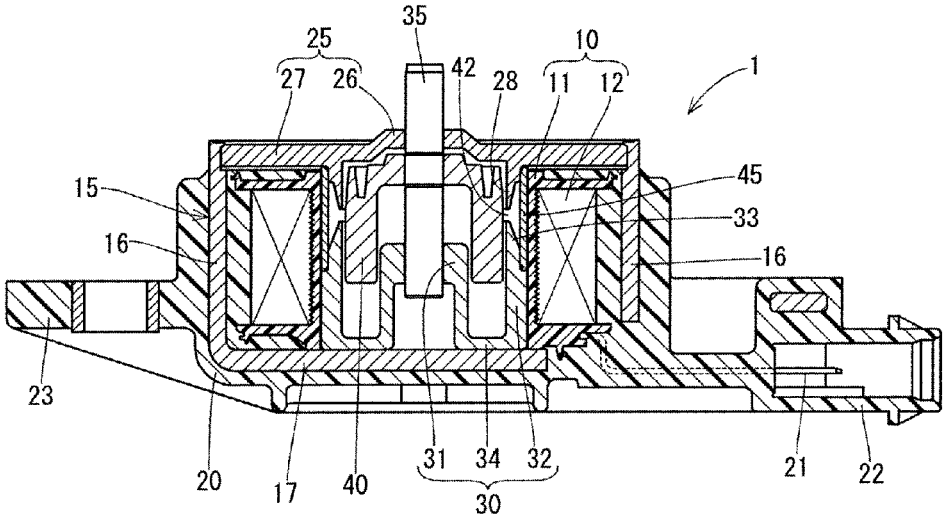
FIG. 3 is a cross-sectional view of the linear solenoid of FIG. 1, showing another operational state, in which the shaft is placed in a full stroke position.

Now, a structure of the linear solenoid 1 will be described with reference to FIGS. 2 and 3.

The linear solenoid 1 includes a coil arrangement 10, a yoke 15, a housing 20, a first stationary core 25, a second stationary core 30, a shaft 35 and a movable core 40.

The coil arrangement 10 includes a bobbin 11 and a coil 12. The bobbin 11 is formed into a tubular form. The coil 12 is formed into an annular form and is made of an electric wire, which is wound around the bobbin 11.

The yoke 15 is made of a magnetic material (a magnetic metal material) and includes a tubular portion 16 and a bottom portion 17. The tubular portion 16 is placed on an outer side of the coil arrangement 10 in the radial direction. The bottom portion 17 is formed integrally with one end part (the lower end part in FIG. 2) of the tubular portion 16.

The housing 20 is a resin member, which is molded integrally with the coil arrangement 10 and the yoke 15 (i.e., the coil arrangement 10 and the yoke 15 being insert molded in the housing 20). The housing 20 includes a connector portion 22 and installing portions 23. Terminals 21, which are electrically connected to the coil 12, are received in the connector portion 22. The installing portions 23 are used to install the housing 20 to, for example, an engine cover (not shown).

The first stationary core 25 is made of a magnetic material (a magnetic metal material) and is placed on one axial side of the coil 12, i.e., is placed at the other end part (the upper end part in FIG. 2) of the tubular portion 16, which is opposite from the one end part of the tubular portion 16 in the axial direction. The first stationary core 25 has a first annular projection 28, which projects toward the bottom portion 17 of the yoke 15 in the axial direction. A radially outer end portion (an outer peripheral portion) of the first stationary core 25 is fixed to the tubular portion 16 of the yoke 15.

The second stationary core 30 is made of a magnetic material (a magnetic metal material) and is placed on the other axial side of the coil 12, i.e., is placed at the one end part of the tubular portion 16. The second stationary core 30 contacts the bottom portion 17 of the yoke 15 in the axial direction and has a second annular projection 33. The second annular projection 33 projects toward the first annular projection 28 in the axial direction such that an air gap 42 is interposed between the second annular projection 33 and the first annular projection 28 in the axial direction. The first stationary core 25 and the second stationary core 30 are magnetically coupled with each other by the yoke 15.

The shaft 35 is slidably supported by the first stationary core 25 and the second stationary core 30 on a radially inner side of the air gap 42. The shaft 35 can axially reciprocate between an initial position, which is located on the second stationary core 30 side, and a full stroke position, which is located on the first stationary core 25 side. FIG. 2 shows one operational state where the shaft 35 is placed in the initial position, and FIG. 3 shows another operational state where the shaft 35 is placed in the full stroke position.

The movable core 40 is made of a magnetic material. The movable core 40 is placed between the first stationary core 25 and the second stationary core 30 in the axial direction and is fixed to the shaft 35. When the shaft 35 is placed in the initial position, the movable core 40 is placed on the second stationary core 30 side of the air gap 42. When the shaft 35 is placed in the full stroke position, the movable core 40 is placed radially inward of the air gap 42 such that the movable core 40 overlaps with both of the first annular projection 28 and the second annular projection 33 to magnetically bypass between the first annular projection 28 and the second annular projection 33, i.e., to conduct the magnetic flux between the first stationary core 25 and the second stationary core 30 through the movable core 40.

Next, a characteristic feature of the structure of the linear solenoid 1 will be described with reference to FIGS. 2 to 8.

The first stationary core 25 includes a bearing portion 26 and a fixing portion 27, which are formed integrally as a single integral member (one-piece member formed seamlessly). The bearing portion 26 slidably supports the shaft 35. The fixing portion 27 radially outwardly extends from the bearing portion 26 and is configured into an annular plate form. The fixing portion 27 has the first annular projection 28, which axially projects toward the second stationary core 30.

The second stationary core 30 includes a bearing portion 31, a magnetic flux conducting portion 32 and a connecting portion 34, which are formed integrally as a single integral member (one-piece member formed seamlessly). The bearing portion 31 slidably supports the shaft 35. The magnetic flux conducting portion 32 is formed into a tubular form and is placed on an outer side of the bearing portion 31 in the radial direction. The connecting portion 34 connects between an end part of the magnetic flux conducting portion 32 and the bearing portion 31 on an axial side where the bottom portion 17 of the yoke 15 is located. The magnetic flux conducting portion 32 has the second annular projection 33, which projects toward the first annular projection 28 such that the air gap 42 is interposed between the second annular projection 33 and the first annular projection 28 in the axial direction.

The linear solenoid 1 includes a collar 45, which is formed into a tubular form and is placed between the first stationary core 25 and the second stationary core 30. The collar 45 is made of a non-magnetic material and serves as a non-magnetic member. One end portion of the collar 45 is press fitted to the first annular projection 28, and the other end portion of the collar 45, which is opposite from the one end portion of the collar 45 in the axial direction, is press fitted to the second annular projection 33. The collar 45 limits or prohibits movement of the first stationary core 25 and the second stationary core 30 relative to each other in both of the axial direction and the radial direction.

The fixing portion 27 of the first stationary core 25 is fitted into the other end part of the tubular portion 16 of the yoke 15. The fixing portion 27 is fixed to the yoke 15 by swaging, i.e., by plastically deforming the other end part of the tubular portion 16 against the fixing portion 27 in a state where the collar 45 and the second stationary core 30 are axially clamped between the bottom portion 17 of the yoke 15 and the fixing portion 27. The first stationary core 25 is magnetically coupled with the tubular portion 16 of the yoke 15 to conduct the magnetic flux therebetween.

The magnetic flux conducting portion 32 of the second stationary core 30 axially contacts the bottom portion 17 of the yoke 15 to magnetically couple between the magnetic flux conducting portion 32 of the second stationary core 30 and the bottom portion 17 of the yoke 15 and thereby to conduct a magnetic flux therebetween.

Figure 4:
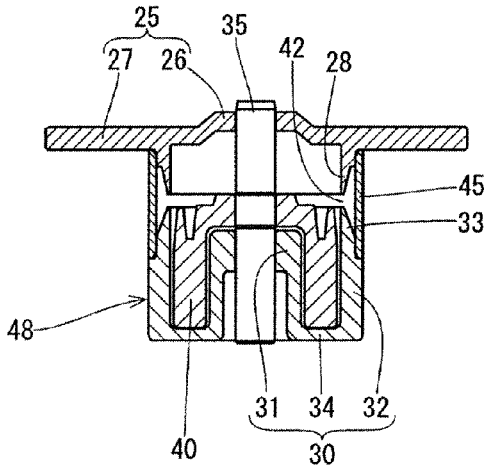
FIG. 4 is a cross-sectional view of a subassembly, in which a first stationary core, a collar, a second stationary core, a shaft and a movable core shown in FIG. 2 are integrally assembled.

At the time of assembling the linear solenoid 1, the collar 45 is press fitted to the first annular projection 28 and the second annular projection 33. Thereby, as shown in FIG. 4, the first stationary core 25, the second stationary core 30, the shaft 35 and the movable core 40 are assembled together to form a subassembly 48.

Figure 5:
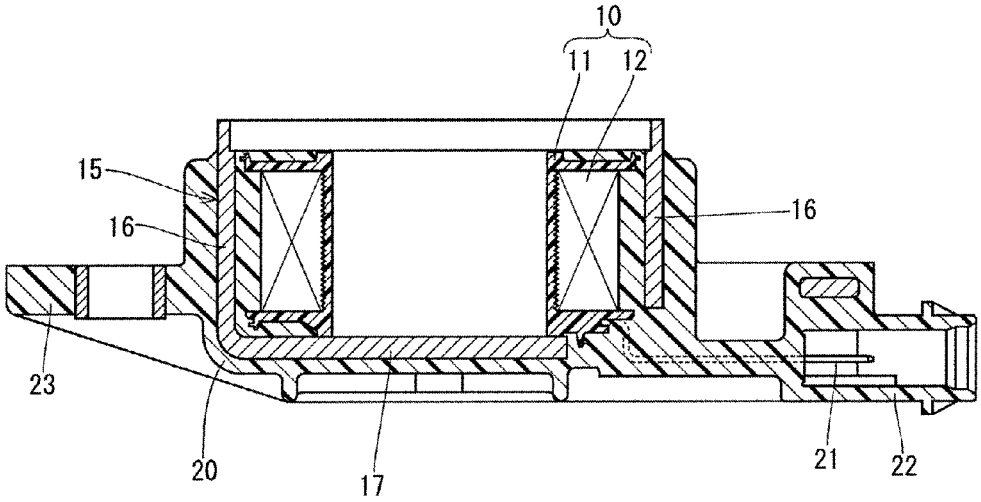
FIG. 5 is a cross-sectional view showing the yoke, a coil arrangement and a housing of FIG. 2.
Figure 6:
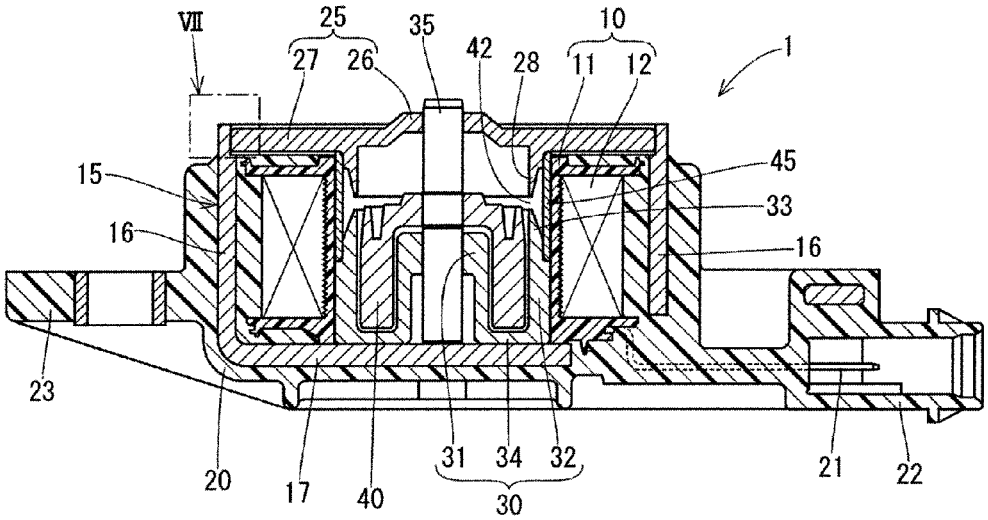
FIG. 6 is a schematic cross sectional view, showing a state where the subassembly of FIG. 4 is inserted into the coil arrangement and the yoke of FIG. 5.
Figure 7:
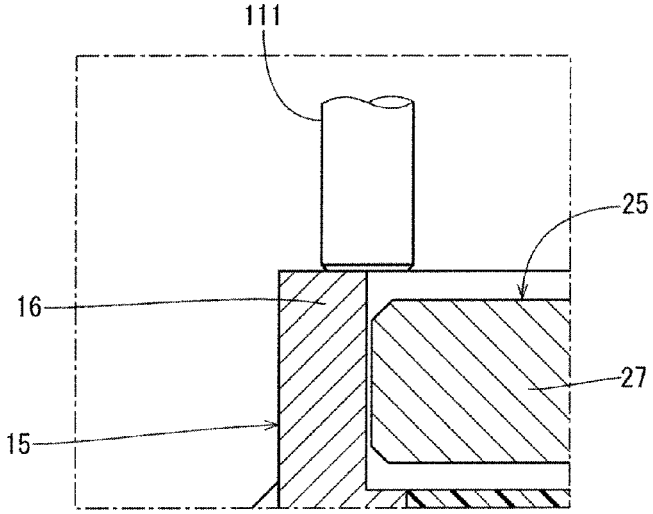
FIG. 7 is a partial enlarged view of an area VII in FIG. 6.
Figure 8:
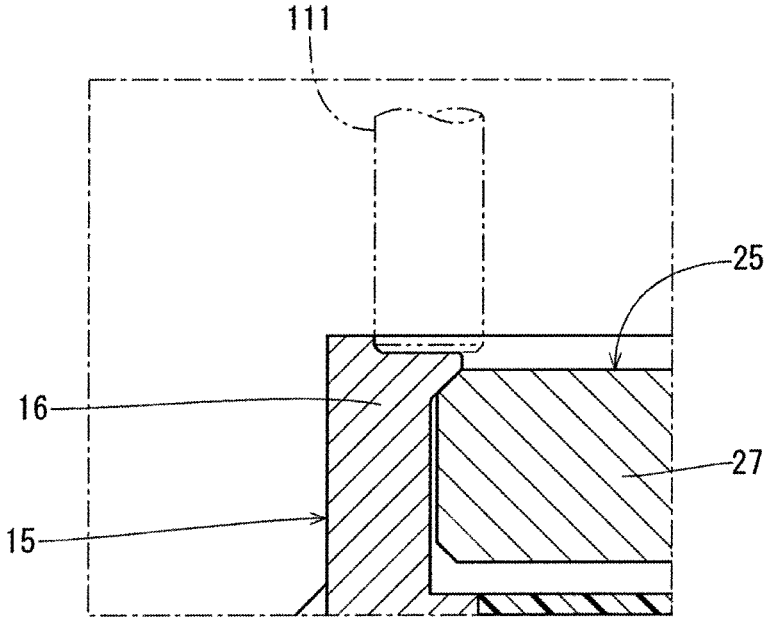
FIG. 8 is a partial enlarged view of an area VIII in FIG. 2.

The subassembly 48 is inserted into the yoke 15 and the coil arrangement 10, which are resin molded together, as shown in FIG. 5, until the second stationary core 30 contacts the yoke 15 in the axial direction, as shown in FIG. 6. In this stage, a minimum size of the radial gap (air gap) between the bobbin 11, which is located on the radially outer side of the radial gap, and the collar 45 and the second stationary core 30, which are located on the radially inner side of the radial gap, is set to be larger than a maximum size of the other radial gap (air gap) between the tubular portion 16 of the yoke 15, which is located on the radially outer side of the other radial gap, and the first stationary core 25, which is located on the radially inner side of the other radial gap. Next, a punch 111, which is shown in FIG. 7, is used to plastically deform the other end part of the tubular portion 16 of the yoke 15 in the state where the second stationary core 30 contacts the yoke 15 in the axial direction to swage the other end part of the tubular portion 16 against the first stationary core 25, as shown in FIG. 8. In this way, the radially outer part of the first stationary core 25 is fixed to the tubular portion 16 of the yoke 15.

Next, the operation of the linear solenoid 1 will be described with reference to FIGS. 1 to 3.

The coil 12 is deenergized when the hydraulic oil is not supplied to the hydraulic pressure chamber 102 of the valve timing control apparatus 100. At this time, the shaft 35 is urged against the bottom portion 17 of the yoke 15 by the spring 110 of the hydraulic pressure change valve 107 through the spool 108, so that the shaft 35 contacts the bottom portion 17 of the yoke 15 and is placed in the initial position.

The coil 12 is energized when the hydraulic oil is supplied to the hydraulic pressure chamber 102 of the valve timing control apparatus 100. The magnetic flux, which is generated around the coil 12 upon the energization of the coil 12, flows through a magnetic circuit that is formed by the first stationary core 25, the yoke 15, the second stationary core 30 and the movable core 40. The magnetic flux is conducted between the first stationary core 25 and the yoke 15 in the radial direction, and the magnetic flux is conducted between the yoke 15 and the second stationary core 30 in the axial direction. At this time, the movable core 40 is driven by a magnetic attractive force, which is generated in response to the amount of the magnetic flux that flows through the magnetic circuit, to drive the shaft 35 together with the movable core 40 from the initial position toward the full stroke position against the urging force of the spring 110.

As discussed above, the linear solenoid 1 of the present embodiment includes the collar 45, which is the non-magnetic member and limits the axial relative movement between the first stationary core 25 and the second stationary core 30. Furthermore, the first stationary core 25 includes the bearing portion 26 and the fixing portion 27, which are formed integrally as the single integral member. The bearing portion 26 slidably supports the shaft 35. The fixing portion 27 radially outwardly extends from the bearing portion 26. The fixing portion 27 is fixed to the yoke 15 in the state where the collar 45 is axially clamped between the fixing portion 27 and the second stationary core 30.

Thus, the first stationary core 25, which includes the bearing portion 26 and the fixing portion 27 formed integrally as the single integral member, is axially supported by the collar 45. Thereby, it is possible to limit the flexion of the first stationary core 25, which would be caused by the axial load applied at the time of fixing the first stationary core 25 against the yoke 15. As a result, it is possible to limit the increase of the size of the air gap between the yoke 15 and the first stationary core 25 and to limit the variation of the size of the air gap between the yoke 15 and the first stationary core 25. In this way, it is possible to increase the magnetic attractive force, and it is also possible to limit the variation of the magnetic attractive force.

Furthermore, the formation of the air gap between the yoke 15 and the first stationary core 25 is limited, so that it is possible to limit intrusion of the foreign objects (e.g., iron debris or iron powder) into the air gap between the yoke 15 and the first stationary core 25, and thereby it is possible to limit the change in the magnetic attractive force.

Furthermore, as discussed above, the flexion of the first stationary core 25 is limited, so that the variation in the size of the clearance between the yoke 15 and the first stationary core 25 is reduced or minimized. Thus, it is possible to reduce or minimize a variation in a plastically deformable margin (a plastically deformable allowance) of the yoke 15, which is plastically deformable by the punch 111 and is required to fix between the yoke 15 and the first stationary core 25 by the swaging, i.e., the plastic deformation. Thus, the quality of the swaging is improved.

Furthermore, when the flexion of the first stationary core 25 is limited, the deformation of the bearing portion 26 is limited. Thus, it is possible to achieve the smooth slide movement of the shaft 35.

Furthermore, the relative axial movement between the first stationary core 25 and the second stationary core 30 is limited by the collar 45, so that the variation in the axial size of the air gap 42 is reduced or minimized. Thereby, the variation in the magnetic attractive force can be limited.

Furthermore, in comparison to a case where the first stationary core 25 is made from a plurality of members, more specifically, a case where the bearing portion 26 and the fixing portion 27 are made as different members, respectively, a magnetic loss at the first stationary core 25 is reduced. Thereby, the magnetic attractive force can be increased, and the first stationary core 25 can be easily assembled.

Furthermore, the first stationary core 25 and the second stationary core 30 are magnetically coupled with each other only by the single yoke 15. Therefore, it is possible to reduce the magnetic loss between the first stationary core 25 and the second stationary core 30. As a result, it is possible to increase the magnetic attractive force.

Furthermore, in the first embodiment, the fixing portion 27 of the first stationary core 25 is fitted to the other end part of the tubular portion 16 of the yoke 15, and the magnetic flux can be radially conducted between the fixing portion 27 and the tubular portion 16. Furthermore, the second stationary core 30 axially contacts the bottom portion 17 of the yoke 15, and the magnetic flux can be axially conducted between the second stationary core 30 and the bottom portion 17 of the yoke 15.

Thus, even in the case where the axial position of the first stationary core 25 and the axial position of the tubular portion 16 of the yoke 15 vary from product to product due to presence of the variations in the first stationary core 25, the second stationary core 30, the collar 45 and the yoke 15, the radial size of the radial air gap between the first stationary core 25 and the tubular portion 16 of the yoke 15 is generally constant. Therefore, the variation in the magnetic attractive force among the products can be reduced or minimized.

In contrast, in a case where the magnetic flux is conducted between the first stationary core and the yoke in the axial direction, when the variation occurs in the axial position of the first stationary core and/or the axial position of the yoke, the size of the axial air gap between the first stationary core and the yoke varies. Thereby, the variation in the magnetic attractive force among the products is disadvantageously increased. Furthermore, in order to flex the first stationary core and the yoke to eliminate the axial air gap discussed above, it is required to reduce the thickness of the first stationary core and the thickness of the yoke. The reduction of the thickness of the first stationary core and the reduction of the thickness of the yoke result in a magnetic loss, which is caused by a magnetic saturation.

Furthermore, in the present embodiment, the one end portion of the collar 45 is press fitted to the first annular projection 28, and the other end portion of the collar 45 is press fitted to the second annular projection 33. The collar 45 limits or prohibits movement of the first stationary core 25 and the second stationary core 30 relative to each other in both of the axial direction and the radial direction.

Thereby, the rigidity of the subassembly 48 can be increased to further limit the flexion of the first stationary core 25 at the time of assembling.

Furthermore, the deviation between the axis of the first stationary core 25 and the axis of the second stationary core 30 can be limited. Thus, a radial force, i.e., a side force, which is exerted against the movable core 40 in the radial direction can be reduced. Therefore, the magnetic attractive force can be stabilized, and the wearing of the bearing portion 26 and the bearing portion 31 upon the slide movement of the shaft 35 relative to the bearing portion 26 and the bearing portion 31 can be reduced. Also, the coaxiality between the bearing portion 26 and the bearing portion 31 can be improved to smoothly slide the shaft 35.

In the present embodiment, at the time of assembling the linear solenoid 1, the collar 45 is press fitted to the first annular projection 28 and the second annular projection 33, and thereby the first stationary core 25, the second stationary core 30, the shaft 35 and the movable core 40 are integrally assembled.

Thereby, the assembling of the linear solenoid 1 is eased.

Now, modifications of the above embodiment will be described.

In a modification of the above embodiment, the fixation between the first stationary core and the yoke is not limited to the swaging and may be made by, for example, press-fitting.

In another modification of the above embodiment, the annular projection may be eliminated from at least one of the first stationary core and the second stationary core. That is, it is only required to provide the air gap between the first stationary core and the second stationary core.

In another modification of the above embodiment, one or all of the first stationary core, the second stationary core and the yoke may have a cross section that is not circular and may have a notch in a circumferential portion thereof.

In another modification of the above embodiment, the collar may be formed into another form that is other than the tubular form. The configuration of the collar may be, for example, a rod form or a plate form as long as the collar can limit the relative movement of the first stationary core and the second stationary core toward each other.

In another modification of the above embodiment, the collar may be engaged with the first stationary core and the second stationary core rather than using the press-fitting. In this way, the collar does not need to integrally assemble the first stationary core, the second stationary core, the shaft and the movable core together.

In another modification of the above embodiment, the liner solenoid is not necessarily implemented as the drive device of the hydraulic pressure change valve of the valve timing control apparatus and may be implemented as a drive device of various other functional apparatuses, each of which includes a driven member that is driven to reciprocate.

The present disclosure is not limited to the above embodiment and modifications thereof. That is, the above embodiment and modifications thereof may be modified in various ways without departing from the spirit and scope of the present disclosure.

What is claimed is:

1. A linear solenoid comprising:

a coil that is formed into an annular form;

a first stationary core that is placed on one side of the coil in an axial direction;

a second stationary core that is placed on the other side of the coil, which is opposite from the one side of the coil in the axial direction, wherein an air gap is interposed between the first stationary core and the second stationary core in the axial direction;

a yoke that is located on an outer side of the coil in a radial direction and magnetically couples between the first stationary core and the second stationary core;

a housing that holds the yoke;

a shaft that is placed on an inner side of the air gap in the radial direction and is slidably supported by the first stationary core and the second stationary core, wherein the shaft is configured to reciprocate in the axial direction between an initial position, which is located on a side where the second stationary core is placed, and a full stroke position, which is located on a side where the first stationary core is placed;

a movable core that is fixed to the shaft at a corresponding location, which is located between the first stationary core and the second stationary core in the axial direction, wherein when the coil is energized, the movable core is moved together with the shaft in the axial direction toward the full stroke position to a position located on the inner side of the air gap in the radial direction and conducts a magnetic flux between the first stationary core and the second stationary core through the movable core; and a non-magnetic member that is held between the first stationary core and the second stationary core and limits relative movement between the first stationary core and the second stationary core toward each other, wherein the first stationary core is formed as a single integral member and includes:

a bearing portion that slidably supports and contacts the shaft; and a fixing portion that outwardly extends from the bearing portion in the radial direction and is fixed to the yoke while the non-magnetic member is clamped between the fixing portion and the second stationary core in the axial direction, wherein the bearing portion and the fixing portion are formed seamlessly as one-piece member;

the yoke includes:

a tubular portion that is placed on the outer side of the coil in the radial direction; and a bottom portion that is formed integrally with one end part of the tubular portion, which is located on an axial side where the second stationary core is located;

the fixing portion of the first stationary core is fitted into the other end art of the tubular portion of the yoke, which is opposite from the one end part of the tubular portion in the axial direction, to conduct the magnetic flux between the fixing portion of the first stationary core and the tubular portion of the yoke in the radial direction; and the second stationary core contacts the bottom portion of the yoke in the axial direction and conducts the magnetic flux between the second stationary core and the bottom portion of the yoke in the axial direction;

the housing is molded from resin and extends along an outer peripheral surface of the tubular portion of the yoke to circumferentially surround the tubular portion of the yoke; and a radial gap is formed between the fixing portion if the first stationary core and the tubular portion.

2. The linear solenoid according to claim 1, wherein:

the non-magnetic member is configured into a tubular form and is fitted to both of the first stationary core and the second stationary core; and the non-magnetic member limits relative movement between the first stationary core and the second stationary core in the radial direction.

3. The linear solenoid according to claim 2, wherein the non-magnetic member is press-fitted to both of the first stationary core and the second stationary core to assemble the first stationary core, the second stationary core, the shaft and the movable core together.

4. The linear solenoid according to claim 2, wherein:

the fixing portion of the first stationary core has a first annular projection, which projects toward the second stationary core;

the second stationary core has a second annular projection, which projects toward the first annular projection;

the air gap is interposed between the first annular projection and the second annular projection;

one end portion of the non-magnetic member is fitted to the first annular projection; and the other end portion of the non-magnetic member, which is opposite from the one end portion of the non-magnetic member in the axial direction, is fitted to the second annular projection.

5. The linear solenoid according to claim 1, wherein the other end part of the tubular portion of the yoke does not radially inwardly extend beyond an outer peripheral portion of the fixing portion on an axial side of the fixing portion, which is opposite from the second stationary core in the axial direction.

6. The linear solenoid according to claim 5, wherein an end surface of the fixing portion, which is opposite from the coil in the axial direction, is uncovered and is thereby exposed to an outside.

7. The linear solenoid according to claim 1, wherein an axial extent of the radial gap, which is measured from an axial end of the fixing portion of the first stationary core located on an axial side where the second stationary core is located, is at least one half of an entire axial extent of the fixing portion of the first stationary core.

8. The linear solenoid according to claim 1, wherein the housing is molded integrally with the coil and circumferentially extends along an inner peripheral surface of the tubular portion of the yoke to securely hold both of the tubular portion and the coil together.

9. The linear solenoid according to claim 1, further comprising a bobbin, which is received in the yoke, wherein:

the coil is wound around the bobbin and is radially placed between the bobbin and the tubular portion of the yoke;

the second stationary core is placed on a radially inner side of the bobbin; and a second radial gap is formed between the bobbin and the second stationary core and is larger than the radial gap, which is formed between the fixing portion of the first stationary core and the tubular portion of the yoke.

10. The linear solenoid according to claim 1, wherein a radially outer part of the bearing portion has an axial end surface, which is axially opposed to the movable core;

the bearing portion has a through-hole, which receives the shaft;

one axial end of the through-hole of the bearing portion, which is located on the movable core side, has a peripheral edge that is placed at a corresponding axial position; and the corresponding axial position of the peripheral edge of the axial end of the through-hole is on an axial side of the axial end surface of the radially outer part, which is opposite from the movable core in the axial direction.

* * * * *